US011052526B2

(12) United States Patent
Brinkmann et al.

(10) Patent No.: US 11,052,526 B2
(45) Date of Patent: Jul. 6, 2021

(54) HAND-HELD POWER TOOL DEVICE

(71) Applicant: Robert Bosch GmbH, Stuttgart (DE)

(72) Inventors: Thomas Brinkmann, Aichtal-Groetzingen (DE); Lars Schmid, Nuertingen (DE); Pascal Schmitz, Leinfelden-Echterdingen (DE); Hardy Schmid, Stuttgart (DE); Patrick Heinen, Ludwigsburg (DE); Jan Koalick, Leinfelden-Echterdingen (DE); Daniel Kuhn, Dettingen an der Erms (DE)

(73) Assignee: Robert Bosch GmbH, Stuttgart (DE)

( * ) Notice: Subject to any disclaimer, the term of this patent is extended or adjusted under 35 U.S.C. 154(b) by 124 days.

(21) Appl. No.: 15/781,812

(22) PCT Filed: Dec. 8, 2016

(86) PCT No.: PCT/EP2016/080174
§ 371 (c)(1),
(2) Date: Jun. 6, 2018

(87) PCT Pub. No.: WO2017/108416
PCT Pub. Date: Jun. 29, 2017

(65) Prior Publication Data

US 2018/0361553 A1 Dec. 20, 2018

(30) Foreign Application Priority Data

Dec. 22, 2015 (DE) ..... 10 2015 226 440.8

(51) Int. Cl.
*B25D 17/00* (2006.01)
*B25F 5/00* (2006.01)
(Continued)

(52) U.S. Cl.
CPC ..... *B25D 17/00* (2013.01); *B25D 16/006* (2013.01); *B25F 5/00* (2013.01);
(Continued)

(58) Field of Classification Search
CPC ..... B25D 17/00; B25D 16/006; B25D 2216/0069; B25D 2216/0084;
(Continued)

(56) References Cited

U.S. PATENT DOCUMENTS 3,327,196 A 6/1967 Sahrbacker
3,746,813 A * 7/1973 Brown ..... H01H 13/62 200/43.17
(Continued)

FOREIGN PATENT DOCUMENTS

CN 1283537 A 2/2001
CN 101085518 A 12/2007
(Continued)

OTHER PUBLICATIONS

International Search Report corresponding to PCT Application No. PCT/EP2016/080174, dated Mar. 2, 2017 (German and English language document) (8 pages).

*Primary Examiner* — Michelle Lopez
(74) *Attorney, Agent, or Firm* — Maginot, Moore & Beck LLP

(57) ABSTRACT

A hand-held power tool device, in particular a hammer drill and/or chisel hammer device, includes at least one operating element and at least one locking unit. The at least one locking unit includes at least one locking element and at least one controllable actuator element. The at least one locking element can be moved from at least one storage position into at least one locking position, and vice versa, and locks the operating element in at least one operating
(Continued)

state in the locking position. The at least one controllable actuator element influences motion of the locking element.

10 Claims, 7 Drawing Sheets

(51) Int. Cl.
*B25D 16/00* (2006.01)
*H01H 9/06* (2006.01)
*H01H 9/20* (2006.01)

(52) U.S. Cl.
CPC ..... *B25D 2216/0069* (2013.01); *B25D 2216/0084* (2013.01); *B25D 2250/145* (2013.01); *B25D 2250/221* (2013.01); *B25D 2250/261* (2013.01); *B25D 2250/265* (2013.01); *H01H 9/06* (2013.01); *H01H 9/20* (2013.01)

(58) Field of Classification Search
CPC ..... B25D 2250/145; B25D 2250/221; B25D 2250/261; B25D 2250/265; B25F 5/00; H01H 9/06; H01H 9/20
USPC ..... 173/170
See application file for complete search history.

(56) References Cited

U.S. PATENT DOCUMENTS

| | | | | |
|---|---|---|---|---|
| 4,132,933 | A * | 1/1979 | Barcz | H02P 7/066 318/17 |
| 4,401,958 | A | 8/1983 | Noorigian | |
| 9,162,352 | B2 * | 10/2015 | Rudolf | B25F 5/00 |
| 2003/0037937 | A1 | 2/2003 | Frauhammer et al. | |
| 2009/0008111 | A1 | 1/2009 | Liebert et al. | |
| 2011/0308920 | A1 * | 12/2011 | Shi | H01H 9/061 200/43.17 |
| 2014/0027253 | A1 | 1/2014 | Braun | |

FOREIGN PATENT DOCUMENTS

| | | | |
|---|---|---|---|
| CN | 101247926 | A | 8/2008 |
| CN | 101337346 | A | 1/2009 |
| CN | 103052473 | A | 4/2013 |
| CN | 104249333 | A | 12/2014 |
| DE | 197 20 947 | A1 | 12/1997 |
| DE | 10 2004 012 433 | A1 | 9/2005 |
| DE | 10 2013 212 907 | A1 | 1/2015 |
| EP | 1 075 905 | A2 | 2/2001 |
| GB | 2 314 288 | A | 12/1997 |

* cited by examiner

HAND-HELD POWER TOOL DEVICE

This application is a 35 U.S.C. § 371 National Stage Application of PCT/EP2016/080174, filed on Dec. 8, 2016, which claims the benefit of priority to Serial No. DE 10 2015 226 440.8, filed on Dec. 22, 2015 in Germany, the disclosures of which are incorporated herein by reference in their entirety.

BACKGROUND

Known from DE 197 20 947 A1 is a combination hammer for selective use as a hammer drill or chipping hammer, which has an operator-control element realized as an ON and/or OFF switch, and a purely mechanical locking unit, the locking unit comprising a movable locking element for locking the operator-control element in at least one operating state.

A locking unit having a purely mechanical locking unit is also known from EP 1 075 905 A2.

Furthermore, known from DE 10 2004 012 433 A1 is a hand-held power tool, realized as a hammer drill, comprising at least one operator-control element that can be locked directly in an operator-control position by means of an actuator element.

SUMMARY

The disclosure is based on a hand-held power tool device, in particular a hammer drill and/or chipping hammer device, having at least one operator-control element that in particular has at least two operator-control positions, particularly preferably at least one, advantageously precisely one, OFF position and at least one operating position and/or ON position, and having at least one locking unit that comprises at least one, advantageously precisely one, in particular movably mounted, locking element, which can be moved from one, advantageously precisely one, storage position into at least one, advantageously precisely one, locking position that, in particular, differs from the storage position, and vice versa, and which in the locking position, in at least one operating state, in particular a locking operating state, locks the locking element, in particular in at least one of the operator-control positions, and particularly preferably in the operating position and/or ON position.

It is proposed that the locking unit have at least one actuator element that can be activated and that is designed to influence a movement of the locking element. "Designed" is to be understood to mean, in particular, specially programmed, configured and/or equipped. That an object is designed for a particular function, is to be understood to mean, in particular, that the object fulfils and/or executes this particular function in at least one application state and/or operating state.

A "hand-held power tool device" in this context is to be understood to mean, in particular, at least a part, in particular a sub-assembly, of a hand-held power tool, advantageously an electric hand-held power tool, in particular a hammer drill and/or chipping hammer. In particular, the hand-held power tool device may also comprise the entire, advantageously electric, hand-held power tool, in particular the entire hammer drill and/or chipping hammer. Furthermore, the hand-held power tool device may comprise, in particular, at least one machine housing, at least one drive unit, advantageously arranged, at least partly, in the machine housing, at least one energy supply unit, advantageously operatively connected at least to the drive unit, at least one working unit, in particular operatively connected to the drive unit, and/or a control unit, in particular for controlling operation of the hand-held power tool. In addition, the hand-held power tool device, at least in the case of being realized as a hammer drill and/or chipping hammer, may advantageously comprise at least one changeover unit that is advantageously designed at least to change an operating mode, preferably at least to change over between a drilling mode and a chipping mode.

An "operator-control element" is further to be understood to mean, in particular, an element, in particular realized as a pressure-operated switch, as a slide switch and/or preferably as a pawl, that in particular can be actuated, advantageously directly, by an operator and that, in particular, can be moved at least from a first operator-control position, preferably the OFF position, into at least one second operator-control position, preferably the operating position and/or ON position, and that is designed to perform and/or exercise, in dependence on an actuation and/or a touch, at least one function associated with the operator-control element, and/or to relay a touch and/or an actuation to at least one further unit for the purpose of activation. The operator-control element in this case may be realized as any operator-control element such as, for example, as a locking switch, in particular for, in particular selectively, initiating a locking, in particular by means of the locking unit, as a changeover switch, in particular for selecting the operating mode, and/or as an activating switch, in particular for activating the drive unit and/or the energy supply unit. Particularly preferably, however, the operator-control element is realized as an ON switch, and in particular is designed to be touched and/or actuated by an operator, at least in the case of a switch-on operation and/or, advantageously, during operation of the hand-held power tool. Particularly preferably in this case the operator-control element is realized as a dead-man's switch and in particular is automatically moved back into one of the operator-control positions, advantageously the OFF position, in particular without actuation and/or locking. For this purpose the hand-held power tool device advantageously comprises at least one resetting element that is designed, in particular, to exert a resetting force upon the operator-control element, at least upon an actuation of the operator-control element. In the present case, the hand-held power tool device advantageously has a plurality of operator-control elements, in particular at least two and/or at least three, preferably at least one ON switch, at least one locking switch and at least one changeover switch that are advantageously designed to perform differing functions.

Further, a "locking unit" is to be understood to mean, in particular, a unit, advantageously an at least partly mechanical unit, that advantageously has at least one operative connection to the control unit and that is designed, in particular in at least one operating state, advantageously at least in the chipping mode, to lock the operator-control element. The locking element in this case may have in particular any, advantageously mechanical, holding element such as, for example, a hook element, a gripping element and/or a latching element. Particularly preferably, the locking element in this case can be moved linearly and/or in a rectilinear movement from the storage position into the locking position. Particularly preferably, the locking element can moreover be moved, at least partly, in a direction that differs from the direction of movement of the operator-control element. Furthermore, an "actuator element" is to be understood to mean, in particular, an element, in particular an element that can be activated hydraulically, pneumatically and/or electrically, and in particular actively, that advantageously has at least one connection to the energy supply unit and/or to a further energy supply unit of the hand-held power tool device, and that in particular, upon being triggered, is designed to alter and/or vary at least one state. Advantageously, the actuator element in this case is arranged, at least partly, preferably at least mostly, and particularly preferably entirely, in the proximity of the operator-control element. "Proximity" is to be understood to mean, in particular, a spatial region composed of points that are distant from a reference point and/or a reference component part, in particular the operator-control element, by less than one third, preferably less than one quarter, preferably less than one sixth, and particularly preferably less than one tenth of a length of main extent of the machine housing, and/or that are each at a distance of not more than 10 cm, preferably of not more than 5 cm, and particularly preferably of not more than 2 cm from a reference point and/or a reference component part, in particular the operator-control element. The expression "at least mostly" in this case is to be understood to mean, in particular, at least 55%, advantageously at least 65%, preferably at least 75%, particularly preferably at least 85%, and particularly advantageously at least 95%. A "length of main extent" of an object in this context is to be understood to mean, in particular, an extent of the object in a direction of main extent of the object. A "direction of main extent" of an object is to be understood to mean, in particular, a direction that is parallel to a direction of a maximum extent of the object.

That an object "influences" a further object is to be understood in this context to mean, in particular, that, in the case of absence or inactivity of the object, the further object has and/or assumes a different state and/or a different attitude, in particular a position and/or orientation, than in the case of presence and/or activity of the object. Particularly preferably, the actuator element in this case is designed to hold the locking element in the storage position and/or the locking position, at least partly, in particular during a locking operation, and/or to move the locking element into the storage position and/or locking position. In particular, a corresponding design of a hand-held power tool device enables flexibility to be improved. In particular, in this case a locking unit, and in particular an actuator element, can be positioned in a particularly flexible manner, with the result that a space requirement can be reduced, and/or a design of the hand-held power tool can be improved, in particular in respect of a handle region and/or a weight distribution. Moreover, a locking unit can be provided that, in particular, is virtually neutral in respect of structural space and advantageously robust, and that advantageously can also be used in existing hand-held power tools and/or machine housings, in particular without the necessity of making extensive structural changes to existing designs. Furthermore, particularly advantageously, service life and/or durability can be improved, wear can be minimized and as a result, in particular, servicing and/or replacement of component parts can be facilitated. Further, advantageously, efficiency, in particular efficiency in respect of structural space, component parts and/or costs, can be improved.

Preferably, the operator-control element defines at least one holding recess, in which the locking element engages in the operating state. Alternatively or additionally, the locking element could define at least one holding recess that at least partly encompasses the operator-control element in the operating state. In particular, a particularly simple and/or secure locking can thereby be achieved between the operator-control element and the locking element.

Advantageously, if the actuator element can be activated electrically, particularly simple activation can be achieved. Moreover, advantageously, operating reliability can be improved, in particular in comparison with a hydraulic and/or pneumatic activation. The control unit in this case is preferably designed to activate the actuator element.

In a preferred design of the disclosure, it is proposed that the actuator element be designed to move the locking element into the locking position, and in particular to hold it in the locking position, advantageously at least contrary to a resetting force, of a further resetting element of the locking unit and/or of the hand-held power tool device, acting upon the operator-control element. An advantageously automatic locking can thereby be achieved, in particular in the locking operating state.

In one design of the disclosure it is proposed that the actuator element comprise at least one, advantageously precisely one, electromagnet, and the locking element be realized so as to be at least partly, preferably at least mostly, and particularly preferably entirely, magnetic. Preferably in this case the electromagnetic is realized so as to be at least substantially cylindrical. An "at least substantially cylindrical" object in this context is to be understood to mean, in particular, an object that deviates from a cylindrical reference object by a volume fraction of not more than 30%, preferably of not more than 20%, and particularly preferably of not more than 10%. It is thereby possible to achieve, in particular, a locking possibility that is technically advantageously simple and/or flexible.

Preferably, the actuator element and the locking element are part of a stroke magnet. Advantageously, the actuator element and/or at least the electromagnet in this case are/is designed to encompass the locking element, at least mostly, and preferably completely. In this case, the locking element is advantageously realized, at least partly, as a plunger core. In particular, an advantageously compact and/or operationally reliable locking operation can thereby be ensured.

In an alternative design of the disclosure, it is proposed that the actuator element be realized, at least partly, so as to be variable in shape. The expression "variable in shape" in this context is to be understood to mean, in particular, that the actuator element has, and/or can assume, in at least one operating state, at least two at least partly different, advantageously substantially different, in particular external, shapes. Advantageously in this case the actuator element can be converted from a first shape to at least one second shape by means of an activation and/or a stimulus. The stimulus in this case may be any stimulus such as, for example, a substance, in particular for triggering a biological and/or chemical reaction, a mechanical force, an electromagnetic field such as, for example, a magnetic field, an electromagnetic radiation such as, for example, light, sound and/or preferably a temperature change, advantageously induced by means of a current feed to the actuator element. Preferably, in this case the actuator element is realized as a shape-memory element and/or as a bimetal element. That two shapes are "substantially different" is to be understood to mean in particular, that contours and/or areas of the shapes differ from each other by at least 0.5%, preferably by at least 1%, and particularly by at least 2%, in particular as viewed in at least one direction. A locking system that advantageously can be used in a flexible manner and/or that is efficient in respect of structural space can thereby be achieved.

Furthermore, it is proposed that the hand-held power tool device have at least one further operator-control element, which has at least three, advantageously at least four, preferably at least five, and particularly preferably a multiplicity of operator-control positions that are at least substantially continuously settable, enabling an advantageously flexible feedback control and/or regulation of operation to be achieved. Advantageously, in this case precisely one of the operator-control positions corresponds to the OFF position, while the further operator-control positions advantageously correspond to operating positions and/or ON positions. The further operator-control element in this case preferably corresponds to the operator-control element and/or is identical with the operator-control element. Preferably, the operator-control element and/or the further operator-control element in this case are/is realized as an ON switch, in particular as a variable-speed switch, in which case, in particular, an actuation travel and/or a pressure travel controls by feedback control and/or regulates a rotational speed, in particular of the drive unit and/or of the work unit. Particularly advantageously, the locking unit, and in particular the locking element, is designed to lock the operator-control element and/or the further operator-control element in a plurality of operator-control positions, and advantageously in each of the operator-control positions, realized, in particular, as operating positions and/or ON positions.

It is additionally proposed that the hand-held power tool device have at least one locking switch, in particular the already previously mentioned locking switch, which, upon being actuated, initiates a locking. In particular, flexibility of operator control can thereby advantageously be increased, and in particular a locking operation can be initiated selectively, and in particular as required, by an operator.

Furthermore, it is proposed that the hand-held power tool device have a control unit, in particular the already previously mentioned control unit, which is designed to take account of at least one actuation and/or operator-control position of the locking switch for the purpose of activating the actuator element. Advantageously, the control unit is additionally designed to take account of an actuation and/or operator-control position of an operator-control element realized as an ON switch, an actuation and/or operator-control position of an operator-control element realized as a changeover switch, and/or an operating mode advantageously selected by means of the changeover unit, for the purpose of activating the actuator element. In particular the control unit in this case may have at least one, in particular optical and/or electrical, sensing unit, which may be designed to sense at least one operating parameter, in particular an actuation and/or operator-control position of the locking switch, an actuation and/or operator-control position of an operator-control element realized as an ON switch, an actuation and/or operator-control position of an operator-control element realized as a changeover switch, and/or an operating mode advantageously selected by means of the changeover unit. Alternatively, however, it is also conceivable for the control unit to be designed to directly sense the operating parameters. In particular, a particularly high degree of flexibility and/or operational reliability can thereby be achieved.

According to a further aspect of the disclosure that, in particular, may be realized on its own or, advantageously, in addition to the previously mentioned aspects of the disclosure, and preferably may be combined with at least some, and advantageously at least most, of the previously mentioned aspects, a hand-held power tool device is proposed, in particular a hammer drill device and/or chipping hammer device, having at least one operator-control element, in particular realized as an ON switch, that in particular has at least two operator-control positions, particularly preferably at least one, advantageously precisely one, OFF position and at least one operating position and/or ON position, having at least one locking unit, which has at least one actuator element that can be activated and that is designed to lock the operator-control element, in particular indirectly and/or directly, in particular in at least one operator-control position, advantageously operating position and/or ON position, and having a control unit, the control unit being designed to take account of at least three, in particular AND-linked, operating parameters. Advantageously, the operating parameters in this case correspond to an actuation and/or an operator-control position of the operator-control element, in particular realized as an ON switch, to an actuation and/or an operator-control position of the locking switch, and to an operating mode, in particular selected by means of the changeover unit, and/or to an actuation and/or an operator-control position of the changeover switch. In particular, the already previously mentioned advantages can thereby be achieved. In particular, a corresponding design of a hand-held power tool device enables flexibility to be improved. In particular, in this case a locking unit, and in particular an actuator element, can be positioned in a particularly flexible manner, with the result that a space requirement can be reduced, and/or a design of the hand-held power tool can be improved, in particular in respect of a handle region and/or a weight distribution. Moreover, a locking unit can be provided that, in particular, is virtually neutral in respect of structural space and advantageously robust, and that advantageously can also be used in existing hand-held power tools and/or machine housings, in particular without the necessity of making extensive structural changes to existing designs. Furthermore, particularly advantageously, service life and/or durability can be improved, wear can be minimized and as a result, in particular, servicing and/or replacement of component parts can be facilitated. Further, advantageously, efficiency, in particular efficiency in respect of structural space, component parts and/or costs, can be improved.

The hand-held power tool device in this case is not intended to be limited to the application and embodiment described above. In particular, the hand-held power tool device may have individual elements, components and units that differ in number from a number stated herein, in order to fulfill an operating principle described herein.

BRIEF DESCRIPTION OF THE DRAWINGS

Further advantages are disclosed by the following description of the drawing. Six exemplary embodiments of the disclosure is represented in the drawing. The drawing, the description and the claims contain numerous features in combination. Persons skilled in the art will also expediently consider the features individually and combine them to create appropriate further combinations.

There are shown.

DETAILED DESCRIPTION

Figure 1:
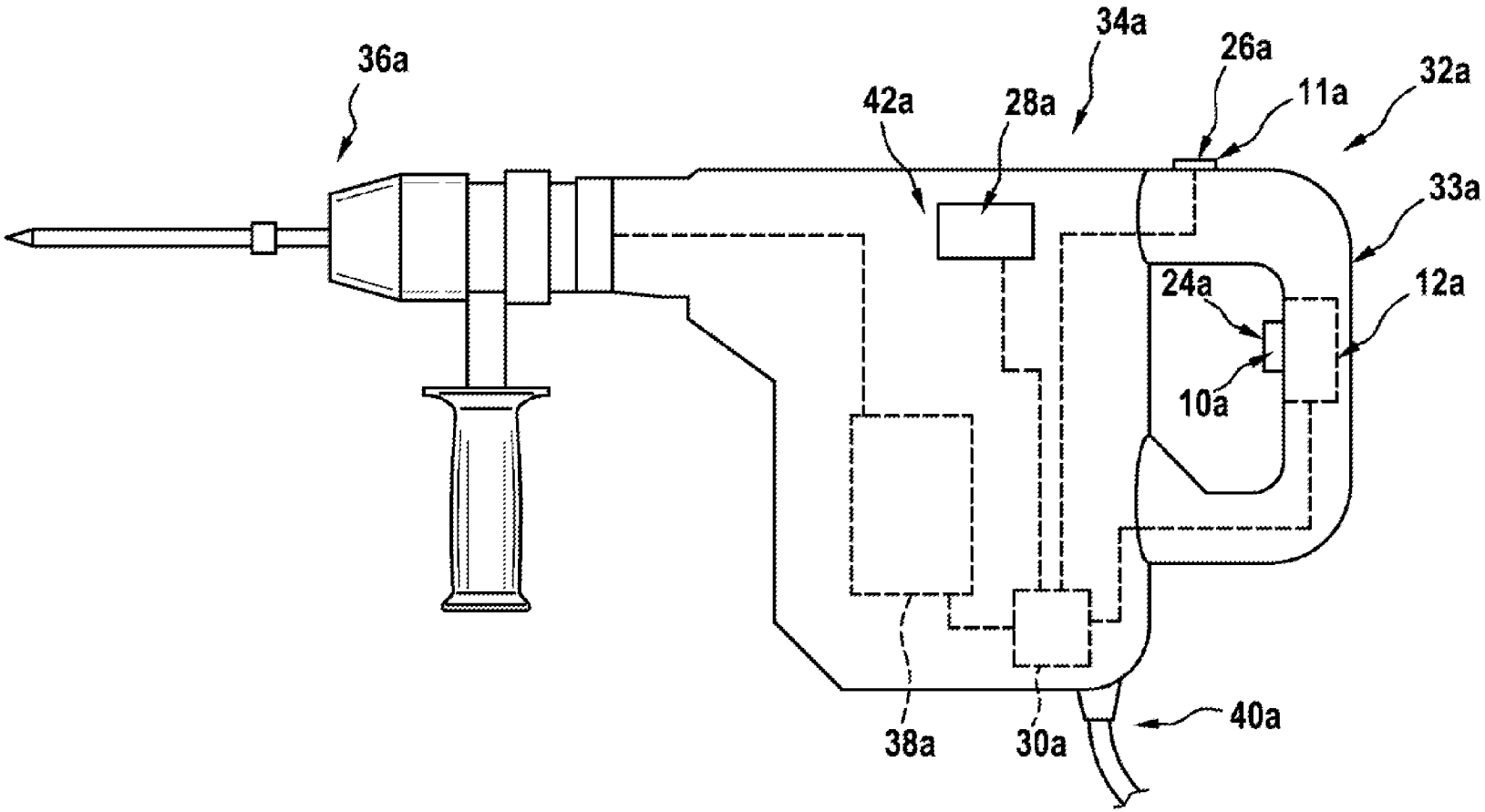
FIG. 1 a hand-held power tool, realized as a combination hammer, having a hand-held power tool device, in a schematic representation, FIG. 2 an operator-control element and a locking unit of the hand-held power tool device in a first operating state, in an enlarged representation, FIG. 3 the operator-control element and the locking unit in a second operating state, in an enlarged representation, FIG. 4 an operator-control element and a locking unit of a further hand-held power tool device in a first operating state, in an enlarged representation, FIG. 5 the operator-control element and the locking unit from FIG. 4 in a second operating state, in an enlarged representation, FIG. 6 an operator-control element and a locking unit of a further hand-held power tool device in a first operating state, in an enlarged representation, FIG. 7 the operator-control element and the locking unit from FIG. 6 in a second operating state, in an enlarged representation, FIG. 8 an operator-control element and a locking unit of a further hand-held power tool device in a first operating state, in an enlarged representation, FIG. 9 the operator-control element and the locking unit from FIG. 8 in a second operating state, in an enlarged representation, FIG. 10 an operator-control element and a locking unit of a further hand-held power tool device in an operating state, in an enlarged representation, FIG. 11 an operator-control element and a locking unit of a further hand-held power tool device in a first operating state, in an enlarged representation, and FIG. 12 the operator-control element and the locking unit from FIG. 11 in a second operating state, in an enlarged representation.

FIG. 1 shows a hand-held power tool 32*a* in a schematic representation. The hand-held power tool 32*a* is realized as a combination hammer, in the present case in particular as a hammer drill and/or chipping hammer. The hand-held power tool 32*a* is realized such that it can be motor-operated. In the present case, the hand-held power tool 32*a* is realized as an electric hand-held power tool. The hand-held power tool 32*a* in this case is cable-connected and thus, in particular, is operated by mains electric power. Alternatively, it is conceivable to realize a hand-held power tool as any other hand-held power tool such as, for example, as a hammer drill, as a chipping hammer, as an impact power drill, as a demolition hammer and/or as a power drill. It is additionally conceivable to realize a hand-held power tool without cable connection and thus, in particular, operated by battery and/or accumulator.

The hand-held power tool 32*a* has a hand-held power tool device. The hand-held power tool device comprises a machine housing 34*a*. The machine housing 34*a* is realized as an external housing. At least a majority of the components required for operation of the hand-held power tool 32*a* are arranged inside the machine housing 34*a*.

The hand-held power tool device additionally has a work unit 36*a*. The work unit 36*a* is arranged in a front region of the machine housing 34*a*. The work unit 36*a* comprises at least one work-tool receiver, which is designed to receive an insert tool. Alternatively, it is conceivable for a work unit to correspond directly to a work tool.

For the purpose of driving and/or operating the work unit 36*a*, the hand-held power tool device comprises a drive unit 38*a*. The drive unit 38*a* is arranged inside the machine housing 34*a*. The drive unit 38*a* comprises a motor, in the present case in particular an electric motor. The drive unit 38*a* has at least one operative connection to the work unit 36*a*. For this purpose, the drive unit 38*a* may comprise further units such as, for example, at least one transmission. Alternatively, it is conceivable to realize a drive unit as an internal combustion engine and/or hybrid motor.

For the purpose of energy supply, the hand-held power tool device additionally comprises an energy supply unit 40*a*. The energy supply unit 40*a* in the present case is realized as a mains electric power connection. The energy supply unit 40*a* has an operative connection to the drive unit 38*a*. The energy supply unit 40*a* is designed, at least, to supply the drive unit 38*a* with energy, in at least one operating state. Alternatively, it is also conceivable to realize an energy supply unit as a petrol tank, as a fuel cell, as a battery and/or advantageously as an accumulator, in particular as an 18 V and/or 36 V accumulator. In particular, in this case the energy supply unit may be fixedly built into a machine housing and/or advantageously realized so as to be changeable and/or replaceable.

Furthermore, the hand-held power tool device comprises further units for operation of the hand-held power tool 32*a*, such as, for example, an electronics unit (not represented) and/or a, in particular electrical, control unit 30*a*. In the present case, the energy supply unit 40*a* is designed to supply energy to the electronics unit and the control unit 30*a*.

The hand-held power tool device additionally has a main handle 33*a*. The main handle 33*a* is realized as a rear handle. The main handle 33*a* is realized on a side of the machine housing 34*a* that faces away from the front region. The main handle 33*a* is designed, at least substantially, for holding and/or guiding the hand-held power tool 32*a*.

Figure 2:
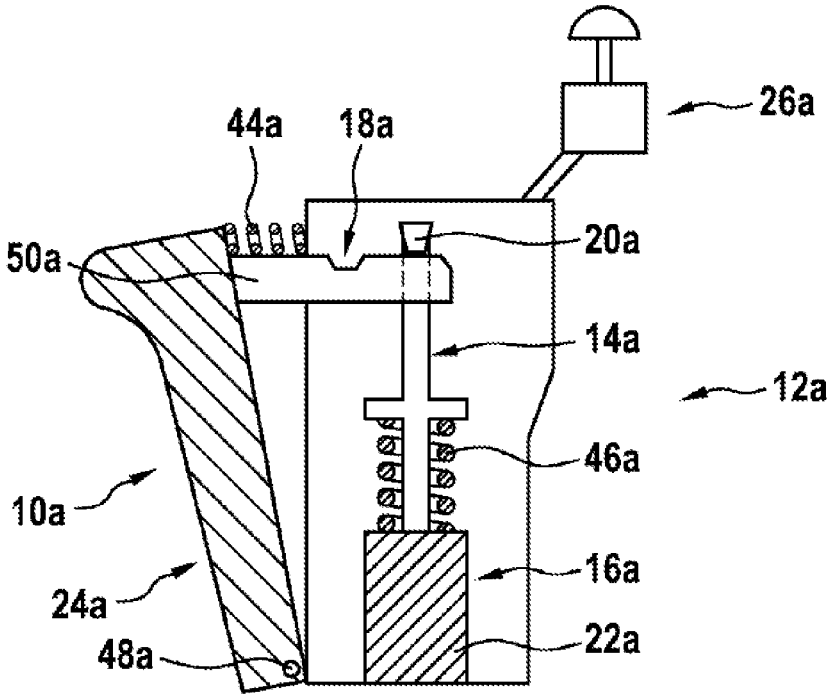
Figure 3:
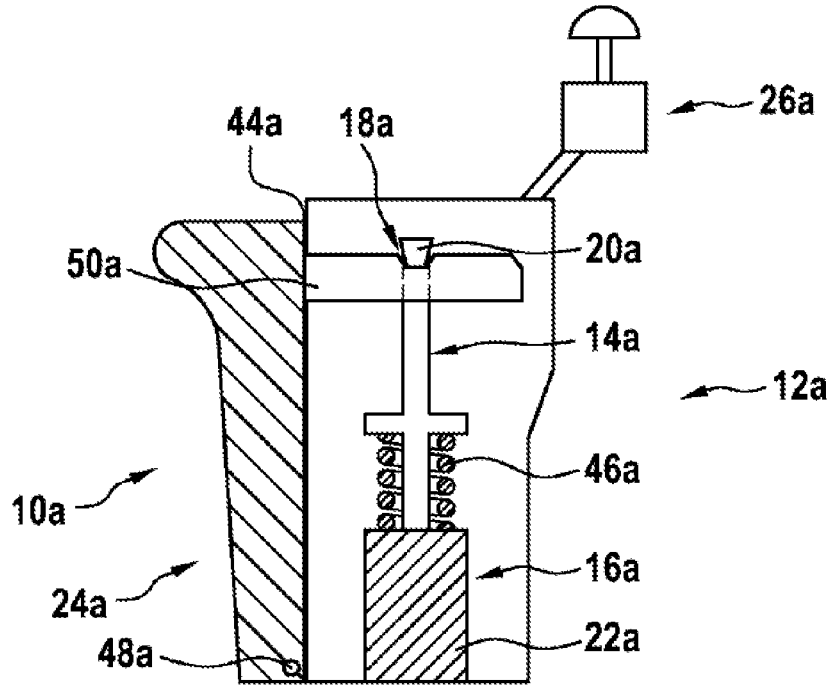

The hand-held power tool device additionally has a first operator-control element 10*a*. The first operator-control element 10*a* is realized as an ON switch 24*a*. The first operator-control element 10*a* is realized as an actuation element. The first operator-control element 10*a* is realized as a pawl. The first operator-control element 10*a* in this case is mounted so as to be pivotable about a pivot axis 48*a* (see also FIGS. 2 and 3). Furthermore, the first operator-control element 10*a* is arranged in the proximity of the main handle 33*a*. The first operator-control element 10*a* is arranged on an inner side of the main handle 33*a*. The first operator-control element 10*a* is arranged, at least partly, inside the machine housing 34*a*. In the present case, the first operator-control element 10*a* has at least one, in particular at least substantially bar-type, guide element 50*a*, which is run at least partly inside the machine housing 34*a*. In addition, the first operator-control element 10*a* is realized as a dead man's switch. The first operator-control element 10*a* in this case is spring-mounted. In the present case, the hand-held power tool device comprises a resetting element 44*a*, in particular realized as a spring, which is designed, at least upon an actuation of the first operator-control element 10*a*, to exert a resetting force upon the first operator-control element 10*e*. The first operator-control element 10*a* also has an operative connection to the control unit 30*a*. The first operator-control element 10*a* is designed to be actuated by an operator for the purpose of operating the hand-held power tool 32*a*. In this case the first operator-control element 10*a* can be moved at least from a first operator-control position, in the present case in particular an OFF position, into at least one second operator-control position, in the present case in particular an ON position. The first operator-control element 10*a* is designed to activate the drive unit 36*a*. The first operator-control element 10*a* is designed, in dependence on an actuation, to directly activate the drive unit 38*a* and/or to supply the drive unit 38*a* with energy, in particular by means of the energy supply unit 40*a*. Alternatively, however, it is also conceivable to mount a first operator-control element in any other manner, such as, for example, so as to be linearly movable, and/or to dispense with a realization as a dead man's switch.

Furthermore, the hand-held power tool device has a second operator-control element 11*a*. The second operator-control element 11*a* is realized as a locking switch 26*a*. The locking switch 26*a* is realized as an actuation element. The locking switch 26*a* is realized as a, in particular electrical, pushbutton. The locking switch 26*a* is arranged in the proximity of the main handle 33*a*.

In the present case, the locking switch 26*a* is arranged on a top side of the main handle 33*a*. The locking switch 26*a* has an operative connection to the control unit 30*a*. The locking switch 26*a* in this case is designed to activate the control unit 30*a*. The locking switch 26*a* additionally serves to initiate a locking that can be triggered, in particular selectively, by the operator. The locking switch 26*a* is thus designed, in the case of a required locking, in the present case in particular of the first operator-control element 10*a* and/or of the ON switch 24*a*, to be actuated by the operator. Alternatively, however, it is also conceivable to dispense with a second operator-control element and/or to arrange a second operator-control element at different position on a machine housing. In this case, a locking operation can be effected at least substantially automatically, for example in dependence on an operating mode and/or a rotational speed of the work unit. It is also conceivable to realize a second operator-control element and/or a locking switch as a slide switch and/or as a touch-sensitive touch element.

Furthermore, the hand-held power tool device has a changeover unit 42*a*. The changeover unit 42*a* has an operative connection to the control unit 30*a*. The changeover unit 42*a* in this case is designed to activate the control unit 30*a*. The changeover unit 42*a* is designed to change an operating mode of the hand-held power tool 32*a*. In the present case, the changeover unit 42*a* serves to change over between a drilling mode and a chipping mode. For this purpose, the changeover unit 42*a* in the present case has a third operator-control element, which is designed as a changeover switch 28*a*. The changeover switch 28*a* is realized as an actuation element. The changeover switch 28*a* is realized as a rotary switch. The changeover switch 28*a* is arranged in a lateral region of the machine housing 34*a*. The changeover switch 28*a* is used by the operator to select the operating mode. The changeover switch 28*a* is designed to be actuated by the operator for the purpose of selecting the operating mode. Alternatively, further operating modes, and/or operating modes other than a drilling mode and a chipping mode, are conceivable, such as, for example, a combined drilling and chipping mode and/or a mode with a defined rotational speed, the changeover unit being used to change between the operating modes. Moreover, it is also conceivable to arrange a third operator-control element and/or a changeover switch at another position on a machine housing, and/or to dispense entirely with a third operator-control element and/or a changeover switch. In this case, a changeover unit could automatically select a suitable operating mode, for example in dependence on an insert tool used and/or on a set and/or settable rotational speed. It is also conceivable to realize a third operator-control element and/or a changeover switch as a slide switch and/or as a tough-sensitive touch element. Further, it is conceivable to realize an ON switch, a locking switch and/or a changeover switch as a single piece.

In the case of hand-held power tool of the stated type, it is frequently advantageous to lock at least one of the operator-control elements 10*a*, 11*a*, in particular at least the ON switch 24*a*, at least temporarily, in the second operator-control position, in particular the ON position, for example in the case of more prolonged chipping work, thereby advantageously enabling the operator to be relieved and at the same time to receive a haptic feedback concerning the locking operation. For this purpose, the hand-held power tool device has a locking unit 12*a*. The locking unit 12*a* is realized so as to be at least partly mechanical. In addition, the locking unit 12*a* is realized so as to be at least partly electrical. The locking unit 12*a* has an operative connection to the control unit 30*a*. The locking unit 12*a* is designed, when in a locking operating state, in the present case in particular in at least one operating state of the chipping mode, to lock at least one of the operator-control elements 10*a*, 11*a*. In the present case, the locking unit 12*a* is designed, when in the locking operating state, in particular of the chipping mode, to lock the first operator-control element 10*a*, in particular in the second operator-control position, in particular the ON position.

For this purpose, the locking unit 12*a* comprises a locking element 14*a*. The locking element 14*a* is arranged entirely within the machine housing 34*a*. The locking element 14*a* is of an at least substantially elongate design. In the present case, the locking element 14*a* is realized as a locking rod. The locking element 14*a* is thus realized substantially in the form of a rod. The locking element 14*a* is realized so as to be magnetic. Moreover, the locking element 14*a* is movably mounted. A direction of movement of the locking element 14*a* in this case is defined by a length of main extent of the locking element 14*a*. In the present case, the locking element 14*a* can be moved at least from a storage position (see FIG. 2) into a locking position (see FIG. 3) and vice versa. The locking element 14*a* in this case can be moved linearly and/or in a rectilinear movement from the storage position into the locking position. In addition, the locking element 14*a* can be moved, at least partly, in a direction that differs from the direction of movement of the first operator-control element 10*a*. In the locking position, the locking element 14*a* is designed to lock the first operator-control element 10*a*. For this purpose, the locking element 14*a* comprises a holding element 20*a*. The holding element 20*a* is realized as a bolt. For the purpose of locking the first locking element 14*a* in the locking position, the holding element 20*a* engages in a holding recess 18*a* of the guide element 50*a* of the operator-control element 10*a*.

For the purpose of influencing a movement of the locking element 14*a*, the locking unit 12*a* comprises a further resetting element 46*a*, in particular realized as a spring. The further resetting element 46*a* is arranged entirely within the machine housing 34*a*. The further resetting element 46*a* has an operative connection to the locking element 14*a*. In the present case, the further resetting element 46*a* bears directly against a T-shaped stop of the locking element 14*a*. The further resetting element 46*a* is designed to hold the locking element 14*a* in the storage position and/or, in at least one operating state, move it back into the storage position.

Furthermore, for the purpose of influencing a movement of the locking element 14*a*, the locking unit 12*a* comprises at least one actuator element 16*a*. In the present case, the locking unit 12*a* comprises precisely one actuator element 16*a*. The actuator element 16*a* is arranged entirely within the machine housing 34*a*. The actuator element 16*a* is arranged entirely in the proximity of the first operator-control element 10*a*. In addition, the actuator element 16*a* is realized such that it can be activated. In the present case, the actuator element 16*a* is realized such that it can be activated electrically. The actuator element 16*a* in this case has an operative connection to the control unit 30*a*, which is designed, in particular, to activate the actuator element 16*a*. Furthermore, the actuator element 16*a* has an operative connection to the energy supply unit 40*a*. In the present case, the actuator element 16*a* is designed to move the locking element 14*a*, in at least one operating state, into the locking position, for the purpose of locking the first operator-control element 10*a*, and in particular to hold it in the locking position until the locking is realized, in particular contrary to a resetting force of the further resetting element 46*a*. For this purpose, the actuator element 16*a* comprises at least one electromagnet 22*a*. In the present case, the actuator element 16*a* comprises precisely one electromagnet 22*a*, and in particular realizes the latter. The electromagnet 22*a* in this case is realized so as to be at least substantially cylindrical, in particular circular-cylindrical. The electromagnet 22*a* is realized in the shape of a hollow cylinder. The electromagnet 22*a* is designed to completely encompass the locking element 14*a*. The actuator element 16*a*, in particular the electromagnet 22*a*, and the locking element 14*a* in this case form a stroke magnet, the locking element 14*a* corresponding, in particular, to a plunger core of the stroke magnet. Alternatively, it is conceivable to use a plurality of actuator elements, a plurality of electromagnets and/or at actuator elements that are at least partly variable in shape. In connection with this it is also conceivable, in particular, to use at least one actuator element that can be activated pneumatically and/or hydraulically.

In the present case, the control unit 30*a* is designed to connect the electromagnet 22*a* to the energy supply unit 40*a* for the purpose of locking, in particular the first operator-control element 10*a*, and thereby in particular to enable current to be fed to the electromagnet 22*a*, as a result of which the, in particular magnetic, locking element 14*a* moves out of the storage position, into the locking position, owing to a magnetic force of the electromagnet 22*a*, contrary to the resetting force of the further resetting element 46*a*. If the current feed is interrupted and/or blocked, the locking element 14*a* moves back into the storage position, owing to the resetting force of the further resetting element 46*a*.

A locking of, and/or a current feed to, the electromagnet 22*a* is effected in this case in dependence on a selected operating mode, in dependence on an operator-control position of the first operator-control element 10*a*, and in dependence on an actuation of the locking switch 26*a*. In this case, for example, it is provided that locking is enabled only in the chipping mode, while locking in the drilling mode is not effected, because of safety regulations. In the present case, the control unit 30*a* is designed to take account of precisely three, in particular AND-linked, operating parameters, in particular the operator-control position of the first operator-control element 10*a*, an actuation of the locking switch 26*a*, and the set and/or selected operating mode, for the purpose of activating the actuator element 16*a* and/or the electromagnet 22*a*. In addition, the control unit 30*a* is designed to sense the operating parameters directly, whereby polling of an operating mode is effected, in particular, electrically. Particularly preferably, the control unit 30 in this case is designed to activate the actuator element 16*a* and/or the electromagnet 22*a* only if the operator-control position of the first operator-control element 10*a* corresponds to the second operator-control position, in particular to the ON position, the operating mode corresponds to the chipping mode, and an actuation of the locking switch 26*a* is effected and/or has been effected, in particular shortly beforehand.

Release of the locking may be effected in this case by means of a change of the operating mode and thus, in particular, by means of an actuation of the changeover switch 28*a*, an actuation of the locking switch 26*a* and/or an actuation of the first operator-control element 10*a*. In all of the stated cases, the control unit 30*a* is designed to release the locking again.

Further exemplary embodiment of the disclosure are shown in FIGS. 4 to 12. The description and the drawings that follow are limited substantially to the differences between the exemplary embodiments, and in principle reference may also be made to the drawings and/or the description of the other exemplary embodiments, in particular of FIGS. 1 to 3, in respect of components that have the same designation, in particular in respect of components denoted by the same references. To distinguish the exemplary embodiments, the letter a has been appended to the references of the exemplary embodiment in FIGS. 1 to 3. In the exemplary embodiments of FIGS. 4 to 12, the letter a has been replaced by the letters b to f.

Figure 4:
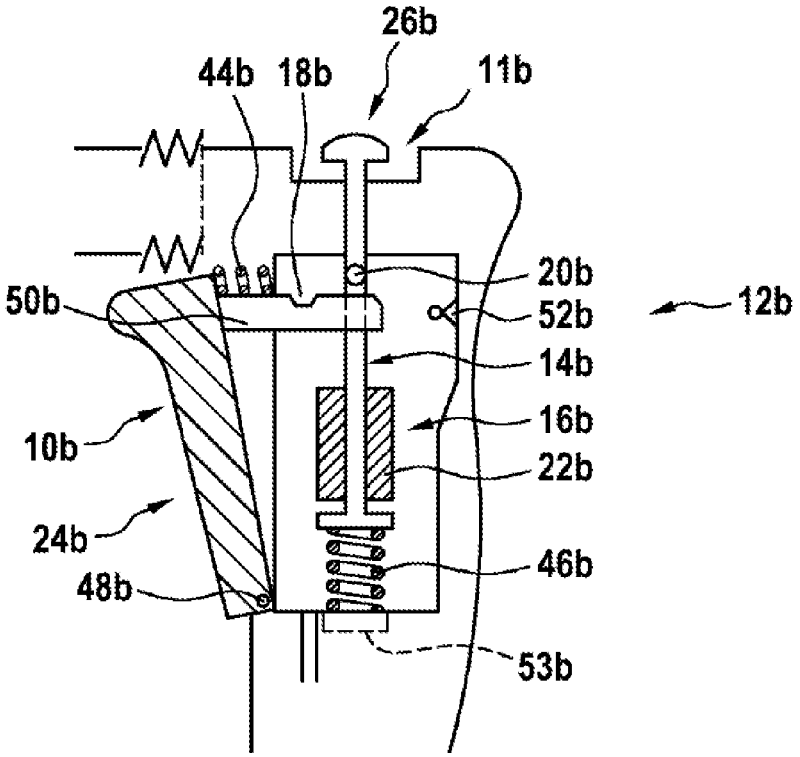
Figure 5:
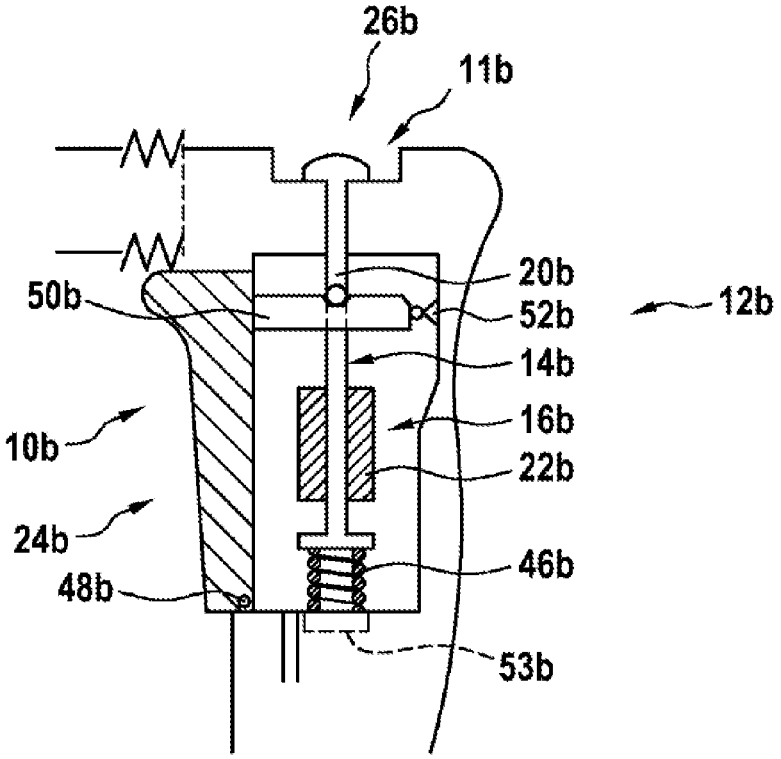

A further exemplary embodiment of the disclosure is shown in FIGS. 4 and 5. The letter b has been appended to the exemplary embodiment of FIGS. 4 and 5. The further exemplary embodiment of FIGS. 4 and 5 differs from the previous exemplary embodiment, at least substantially, by a locking unit 12*b*.

In the present case, a locking switch 26*b* is realized as a pushbutton, in particular as a pushbutton that can be actuated linearly. In addition, the locking switch 26*b* is mechanically connected to a locking element 14*b* of the locking unit 12*b*. In the present case, the locking switch 26*b* is realized so as to constitute a single piece with the locking element 14*b*, and in particular is designed, upon being actuated, to transmit a linear movement directly to the locking element 14*b*. A movement of the locking element 14*b* from a storage position (see FIG. 4) into a locking position (see FIG. 5) is thus effected manually by means of an actuation of the locking switch 26*b*. In this case, an actuator element 16*b* of the locking unit 12*b* is designed to hold the locking element 14*b* in the locking position, at least temporarily, in particular during a locking of a first operator-control element 10*b*, and in particular in a chipping mode. Alternatively, however, it is also conceivable for a locking switch to be indirectly mechanically connected to a locking element, such as, for example, by means of a transmission.

Furthermore, the hand-held power tool device in the present case comprises a sensing unit, in particular an additional sensing unit. The sensing unit has an operative connection to a control unit 30*b*. The sensing unit comprises a first sensing element 52*b*, in particular realized as a microswitch, for sensing an actuation and/or an operator-control position of the first operator-control element 10*b*. The first sensing element 52*b* is designed to transmit a sensed actuation and/or operator-control position of the first operator-control element 10*b* to the control unit 30*b*. The sensing unit further comprises a second sensing element 53*b*, in particular realized as a pressure sensing element, for sensing an actuation and/or an operator-control position of the locking switch 26*b*. The second sensing element 53*b* is designed to transmit a sensed actuation and/or operator-control position of the locking switch 26*b* to the control unit 30*b*. Alternatively, however, it is conceivable to dispense with an additional sensing unit and/or to realize at least one sensing element as any other sensing element.

Figure 6:
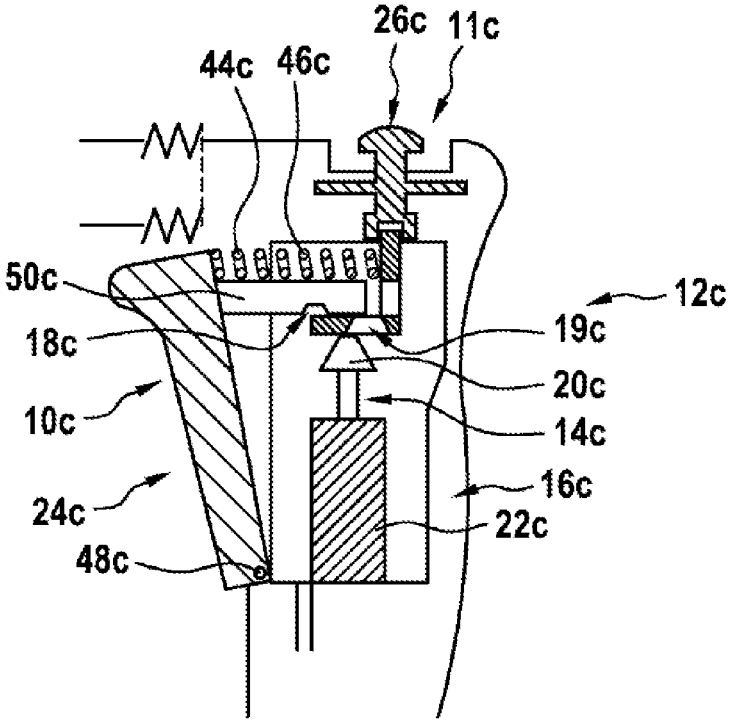
Figure 7:
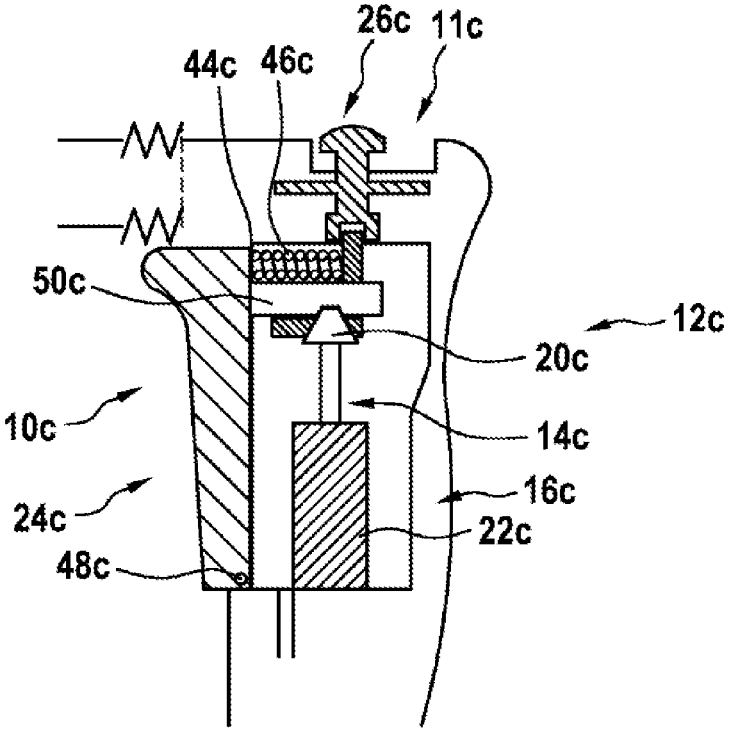

A further exemplary embodiment of the disclosure is shown in FIGS. 6 and 7. The letter c has been appended to the exemplary embodiment of FIGS. 6 and 7. The further exemplary embodiment of FIGS. 6 and 7 differs from the previous exemplary embodiments, at least substantially, by a locking unit 12*c*.

In the present case, a second operator-control element 11*c* and/or a locking switch 26*c* are/is realized as a slide switch, and defines at least one further holding recess 19*c*. In this case a locking element 14*c* of the locking unit 12*c*, in a locking operating state, engages in a holding recess 18*c* of a first operator-control element 10*c* and in the holding recess

19*c* of the second operator-control element 11*c*. Accordingly, the locking element 14*c*, in the locking operating state, and in particular in a locking position, locks the first operator-control element 10*c*, in particular realized as an ON switch 24*c*, and the second operator-control element 11*c*, in particular realized as a locking switch 26*c*. Alternatively, it is also conceivable that a locking element may be designed merely to lock a second operator-control element, in particular realized as a locking switch.

Figure 8:
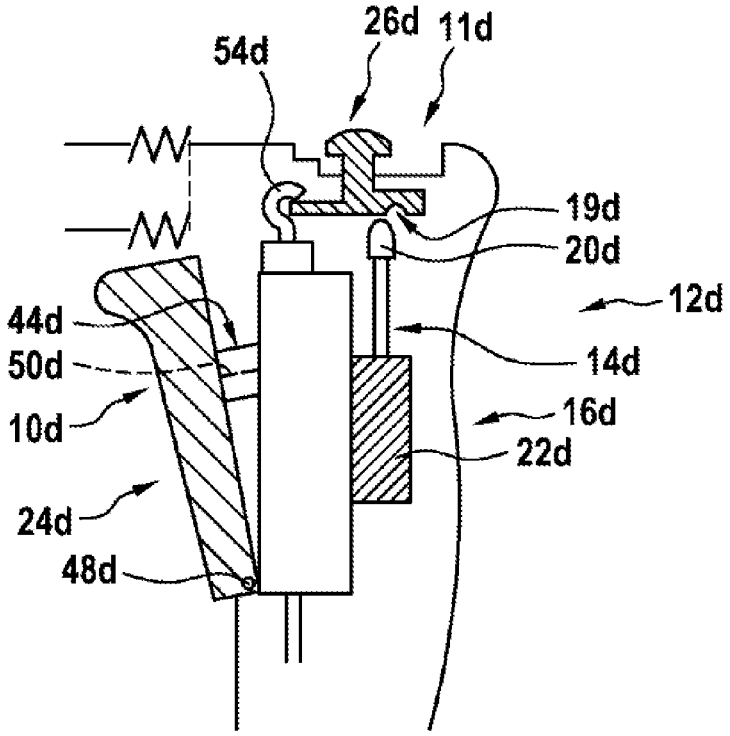
Figure 9:
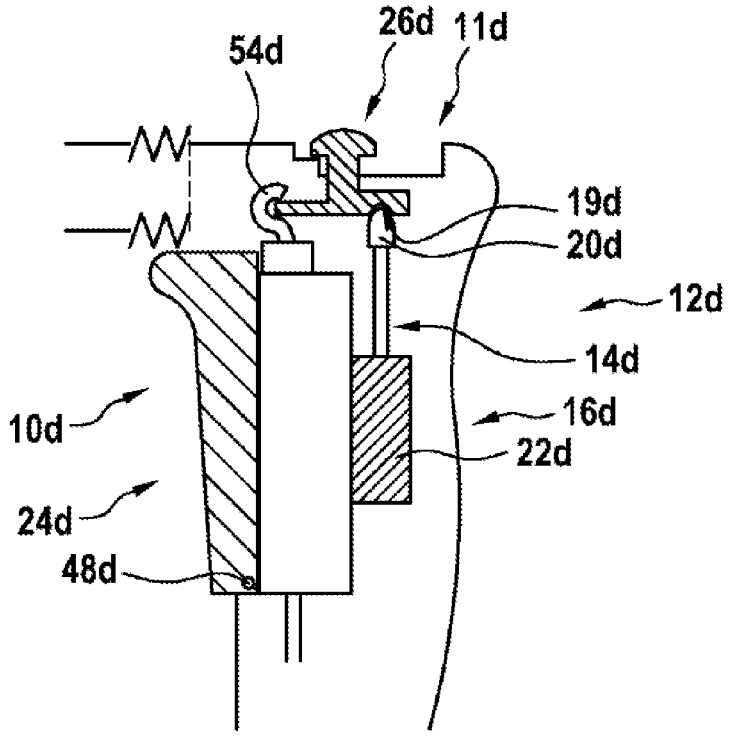

A further exemplary embodiment of the disclosure is shown in FIGS. 8 and 9. The letter d has been appended to the exemplary embodiment of FIGS. 8 and 9. The further exemplary embodiment of FIGS. 8 and 9 differs from the previous exemplary embodiments, at least substantially, by a first operator-control element 10*d* and a locking unit 12*d*.

The first operator-control element 10*d* has at least three operator-control positions. In the present case, the first operator-control element 10*d* has a multiplicity of operator-control positions that, at least substantially, are continuously settable. One of the operator-control positions in this case corresponds to an OFF position, while the further operator-control positions correspond to differing ON positions. The first operator-control element 10*d* is realized as a variable-speed switch, a pressure travel regulating a rotational speed of a drive unit 38*a* and/or of a work unit 36*a*.

Furthermore, in the present case the locking unit 12*d* is designed to lock the operator-control element 10*d* in a plurality of the operator-control positions realized as ON positions. For this purpose the locking unit 12*d* comprises a first locking element 14*d*. The first locking element 14*d* corresponds, at least substantially, to a locking element 14*c* of the previous exemplary embodiment. The first locking element 14*d* is designed to directly lock a second operator-control element 11*d* and/or a locking switch 26*d*. In addition, the first locking element 14*d* is designed to indirectly lock the first operator-control element 10*d*.

Furthermore, in the present case the locking unit 12*d* comprises a second locking element 54*d*. The second locking element 54*d* is arranged entirely within a machine housing 34*d*. The second locking element 54*d* is realized as a locking hook. The second locking element 54*d* is thus realized substantially in the shape of a hook. The second locking element 54*d* has an operative connection to a guide element 50*d* of the first operator-control element 10*d*, which guide element 50*d* in the present case is realized as a cable pull. The second locking element 54*d* is movably mounted. A direction of movement of the second locking element 54*d* in this case is at least substantially parallel to a direction of movement of the second operator-control element 11*d* and/or of the locking switch 26*d*. In the present case, the second locking element 54*d* can be moved at least from a further storage position (see FIG. 8) into a further locking position (see FIG. 9) and vice versa. The second locking element 54*d* in this case is pivotally mounted. In addition, the second locking element 54*d* can be moved, at least partly, in a direction parallel from the direction of movement of the first operator-control element 10*d*. In the further locking position, the second locking element 54*d* is designed to lock the first operator-control element 10*d* in a current operator-control position, in particular an ON position.

Figure 10:
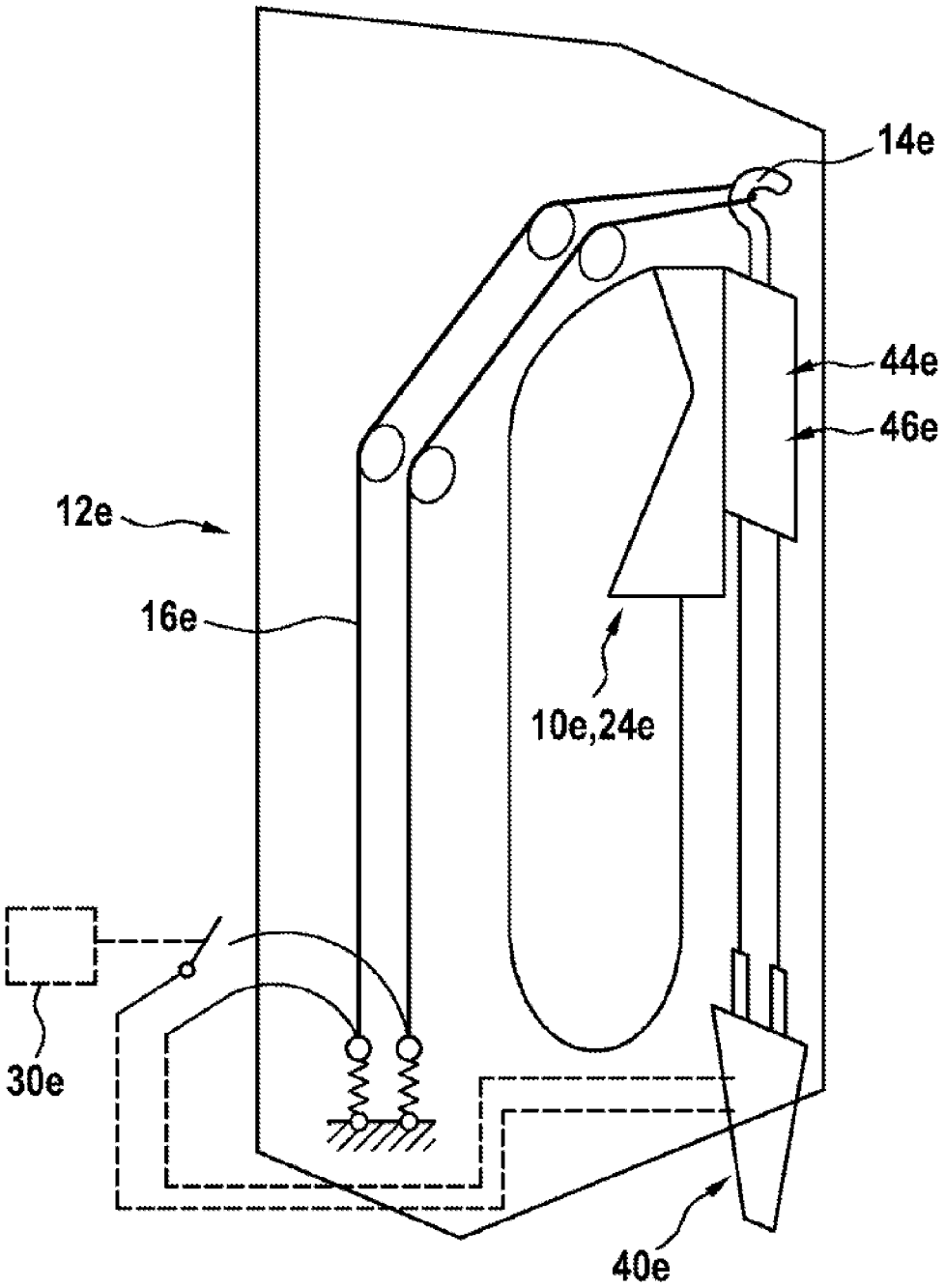

A further exemplary embodiment of the disclosure is shown in FIG. 10. The letter e has been appended to the exemplary embodiment of FIG. 10. The further exemplary embodiment of FIG. 10 differs from the previous exemplary embodiments, at least substantially, by a locking unit 12*e*.

In the present case, the first operator-control element 10*e* corresponds substantially to a first operator-control element 10*d* of the previous exemplary embodiment. In addition, a locking element 14*e* corresponds, at least substantially, to a second locking element 54*e* of the previous exemplary embodiment.

In addition, an actuator element 16*e* of the locking unit 12*e* is realized, at least partly, so as to be variable in shape. The actuator element 16*e* is realized as wire. The actuator element 16*e* has a length of between 100 mm and 500 mm, and advantageously of between 200 mm and 300 mm. In the present case, the actuator element 16*e* has a length of approximately 250 mm. The actuator element 16*e* has a diameter of between 0.05 mm and 2 mm, and advantageously of between 0.1 mm and 1 mm. In the present case, the actuator element 16*e* has a diameter of approximately 0.17 mm. The actuator element 16*e* is realized as a shape-memory element. The actuator element 16*e* is composed of a nickel-titanium alloy (Nitanol). The actuator element 16*e* is arranged, at least partly, in the proximity of the first operator-control element 10*e*. The actuator element 16*e* is spring-mounted and encompasses the locking element 14*e*, at least substantially, in the form of a loop. The actuator element 16*e* in this case has at least two shapes and, by means of a temperature change induced by a current feed to the actuator element 16*e*, such as, for example, at 0.55 A and 12 V, in particular heating to approximately 90° C., can be converted from the first shape to the second shape. In the present case, the actuator element 16*e* contracts when fed with current, with a change in length, in the present case of approximately 2%, resulting in locking of the locking element 14*e*.

Provided in this case is a control unit 30*e*, which is designed to connect the actuator element 16*e* to an energy supply unit 40*e* for the purpose of locking, in particular the first operator-control element 10*e*, and thereby in particular to enable current to be fed to the actuator element 16*e*, as a result of which the actuator element 16*e* contracts and the locking element 14*e* moves, contrary to a resetting force of a further resetting element 46*a*, out of a storage position, into a locking position. If the current feed is interrupted and/or blocked, the locking element 14*e* moves back into the storage position within not more than 2 s, owing to the resetting force of the further resetting element 46*a*. Alternatively, it is conceivable that an actuator element could be composed, at least partly, of any other material such as, for example, of a nickel-titanium-copper alloy, a copper-zinc alloy, a copper-zinc-aluminum alloy, and/or a copper-aluminum nickel alloy, or the like.

Figure 11:
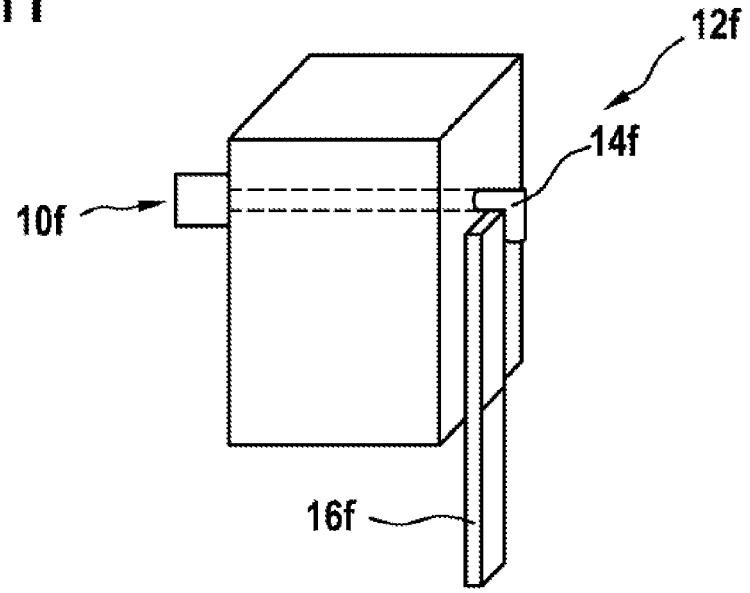
Figure 12:
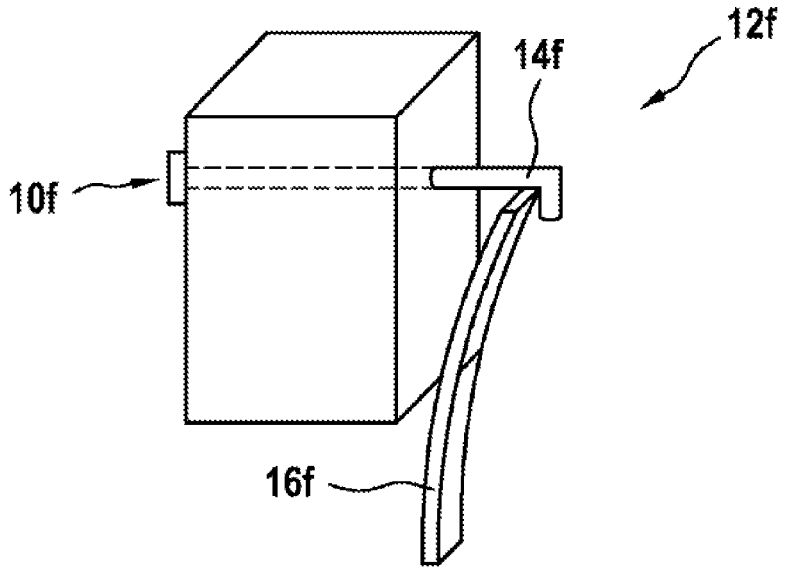

A further exemplary embodiment of the disclosure is shown in FIGS. 11 and 12. The letter f has been appended to the exemplary embodiment of FIGS. 11 and 12. The further exemplary embodiment of FIGS. 11 and 12 differs from the previous exemplary embodiments, at least substantially, by an actuator element 16*f*.

In this case, the actuator element 16*f* is realized as a bimetal element that is variable in shape. In this case, a travel change parallel to a direction of actuation of a first operator-control element 10*f* and/or an actuator travel correspond to approximately 5 mm.

The invention claimed is:

1. A hand-held power tool device, comprising:

at least one operator-control element; and at least one locking unit including:

at least one locking element configured to be moved from at least one storage position into at least one locking position, and from the at least one locking position into the at least one storage position; and at least one actuator element configured to be activated and to move the at least one locking element from the at least one storage position to the at least one locking position, wherein, the at least one actuator element is configured to be activated electrically, and in the at least one locking position, in at least one operating state, the at least one locking element locks the at least one operator-control element.

2. The hand-held power tool device as claimed in claim 1, wherein:

the at least one operator-control element defines at least one holding recess; and the at least one locking element engages the at least one holding recess in the at least one operating state.

3. The hand-held power tool device as claimed in claim 1, wherein:

the at least one actuator element includes at least one electromagnet; and the at least one locking element is configured to be at least partly magnetic.

4. The hand-held power tool device as claimed in claim 1, wherein the at least one actuator element and the at least one locking element are part of a stroke magnet.

5. The hand-held power tool device as claimed in claim 1, wherein the at least one actuator element is configured, at least partly, to be variable in shape.

6. The hand-held power tool device as claimed in claim 1, further comprising:

at least one further operator-control element including at least three operator-control positions.

7. The hand-held power tool device as claimed in claim 1, further comprising:

at least one locking switch which, upon being actuated, initiates a locking.

8. The hand-held power tool device as claimed in claim 7, further comprising:

a control unit configured to take account of at least one actuation and/or operator-control position of the at least one locking switch so as to activate the at least one actuator element.

9. The hand-held power tool device as claimed in claim 1, wherein the hand-held power tool device is a hammer drill and/or chipping hammer device.

10. A hand-held power tool device, comprising:

at least one operator-control element; and at least one locking unit including:

at least one locking element configured to be at least partly magnetic and configured to be moved with respect to the at least one operator-control element from at least one storage position into at least one locking position, and from the at least one locking position into the at least one storage position; and at least one actuator element including at least one electromagnet and configured to be activated and to influence the movement of the at least one locking element, wherein, in the at least one locking position, in at least one operating state, the at least one locking element locks the at least one operator-control element.

* * * * *